US008002881B2

(12) United States Patent
Bagwell et al.

(10) Patent No.: US 8,002,881 B2
(45) Date of Patent: Aug. 23, 2011

(54) FUME TREATMENT METHOD AND APPARATUS USING ULTRAVIOLET LIGHT TO DEGRADE CONTAMINANTS

(75) Inventors: Rick Bagwell, Scottsville, KY (US); Darren Beardslee, Bowling Green, KY (US); Derek Schrock, Bowling Green, KY (US); Andrey Livchak, Bowling Green, KY (US)

(73) Assignee: Oy Halton Group Ltd., Vantaa (FI)

( * ) Notice: Subject to any disclaimer, the term of this patent is extended or adjusted under 35 U.S.C. 154(b) by 979 days.

(21) Appl. No.: 11/308,334

(22) Filed: Mar. 16, 2006

(65) Prior Publication Data

US 2006/0219235 A1 Oct. 5, 2006

Related U.S. Application Data

(60) Provisional application No. 60/662,507, filed on Mar. 16, 2005.

(51) Int. Cl.
*A61L 2/10* (2006.01)

(52) U.S. Cl. ..... 96/224; 55/DIG. 36; 126/299 F; 422/4; 422/24; 422/121

(58) Field of Classification Search ..... 55/DIG. 36; 96/223–224; 210/748; 422/4, 24, 186.3, 422/121

See application file for complete search history.

(56) References Cited

U.S. PATENT DOCUMENTS

| | | | | |
|---|---|---|---|---|
| 4,230,571 | A * | 10/1980 | Dadd | 210/760 |
| 4,936,288 | A * | 6/1990 | Lazard | 126/299 D |
| 5,124,131 | A * | 6/1992 | Wekhof | 422/186.3 |
| 5,675,153 | A * | 10/1997 | Snowball | 250/438 |
| 5,887,478 | A * | 3/1999 | Wang et al. | 73/168 |
| 6,238,628 | B1 * | 5/2001 | Matsutani | 422/172 |
| 6,454,952 | B1 * | 9/2002 | Thorpe | 210/198.1 |
| 6,547,963 | B1 * | 4/2003 | Tsai | 210/232 |
| 6,878,195 | B2 * | 4/2005 | Gibson | 96/224 |
| 6,893,610 | B1 * | 5/2005 | Barnes | 422/4 |
| 6,939,397 | B2 * | 9/2005 | Nelsen et al. | 96/224 |
| 7,001,571 | B2 * | 2/2006 | Forney et al. | 422/22 |
| 7,166,230 | B2 * | 1/2007 | Nilsen et al. | 210/739 |
| 7,498,009 | B2 * | 3/2009 | Leach et al. | 423/235 |
| 2003/0080071 | A1 * | 5/2003 | Williamson et al. | 210/748 |
| 2003/0209501 | A1 * | 11/2003 | Leung | 210/748 |
| 2004/0110458 | A1 * | 6/2004 | Kato et al. | 454/1 |
| 2005/0163648 | A1 * | 7/2005 | Liang | 422/1 |
| 2005/0173352 | A1 * | 8/2005 | Burrows et al. | 210/748 |
| 2005/0269521 | A1 * | 12/2005 | Zagrobelny | 250/435 |
| 2006/0159598 | A1 * | 7/2006 | Wu | 422/186.3 |

* cited by examiner

*Primary Examiner* — Duane Smith
*Assistant Examiner* — Ives Wu
(74) *Attorney, Agent, or Firm* — Miles & Stockbridge, P.C.; Mark A. Catan

(57) ABSTRACT

An ultraviolet treatment chamber for treating exhaust streams, particularly those containing organic particulates, utilizes ultraviolet light energy very efficiently. This is done by setting up a circulating flow in a treatment plenum so that all of the effluent experiences a substantially uniform residence time without the need for baffles or other flow controllers that would block the ultraviolet light.

4 Claims, 5 Drawing Sheets

FUME TREATMENT METHOD AND APPARATUS USING ULTRAVIOLET LIGHT TO DEGRADE CONTAMINANTS

CROSS REFERENCE TO RELATED APPLICATIONS

This application claims priority to U.S. Provisional Application No. 60/662,507, filed Mar. 16, 2005.

FIELD OF THE INVENTION

The present invention relates to exhaust systems that withdraw fumes from a conditioned space and release at least partly cleaned air to the ambient atmosphere using ultraviolet light to reduce the contamination level.

BACKGROUND OF THE INVENTION

Exhaust hoods are used to remove air contaminants close to the source of generation located in a conditioned space. For example, one type of exhaust hoods, kitchen range hoods, creates suction zones directly above ranges, fryers, or other sources of air contamination. The exhaust stream from such applications often contain large quantities of particulates, particularly hydrocarbons such as oil droplets. Organic substances in the form of vapours or particles can also be formed by many production processes within various industries. For example, they can be generated by preparation and use of lacquer and paint, cereal and feedstuff, metal and plastic, tar and asphalt, tanneries, incinerating plants, bio-gas plants, agriculture, and many food preparation processes.

Because of concerns about the environment and worker health, there is a great need for economically attractive mechanisms for removing organic substances from air streams. Air purification is frequently performed by filtering the contaminated air in, for example, grease filters and carbon filters. Mechanical filters, however, are expensive in terms of maintenance manpower and pressure drop (which leads to high operating costs. Furthermore, filters cannot guarantee fulfillment of high hygienic requirements.

One technology that has been used for degrading organic particulates in effluent streams is the addition of ozone to the effluent stream. This can be accomplished by irradiating with ultraviolet light or using a corona discharge. A negative side effect of using corona discharge is the creation of NOx.

One example of an application of ultraviolet light to the purification of an effluent stream is described in U.S. Pat. No. 6,179,969 to Larson. In the embodiment described, contaminated air flows into a chamber which and diluted with ambient air to cool it and add oxygen to the air stream. The effluent stream is then irradiated with ultraviolet light and then ejected to the ambient. The system may include a filter for removing larger particles before introduction of the effluent stream into the dilution section. Cooling of the stream causes condensation of water and certain organic vapors. The oxygen injected in the dilution process is used in the creation of ozone when the air is irradiated with the ultraviolet light. Certain organic substances are oxidized by the ozone in a so-called cold combustion and are thereby transformed into carbon dioxide, but many organic molecules can not be oxidized in this way. The ultraviolet light, however, also splits many of the organic molecules, making them more susceptible to oxidation by ozone. The specification teaches that the oxidation process is not instantaneous and, therefore, the effluent stream must be exposed to the ultraviolet source for a substantial period of time before being ejected into the atmosphere.

Another device that relies on ultraviolet radiation is shown in Japanese Application No. 08019379, published Jul. 22, 1997. The document describes a range hood with a self-cleaning function. A light coating of catalyst is formed on filters irradiated by a bank of ultraviolet lamps located in front of an exhaust aperture. Effluent streams past the catalyst and lamps and is oxidized by contact with the degraded and exposure to the light and ozone created by the light. Many patents have issued that describe similar systems employing photocatalysts.

One of the problems inherent in any system in which ozone, or any other agent, is relied upon for the treatment of an effluent stream, is insuring a uniform dwell-time or residence-time of every part of the effluent stream. Short circuiting by some of the effluent stream is a problem, since the flow moving from a narrow high velocity stream to a large-diameter slow moving stream must give up energy by generating energetic subflows. These can randomly crisscross a chamber causing some of the flow to short-circuit the chamber. A large number of baffles can be used to spread the flow, but to do so, requires a high pressure drop and the baffle elements interfere with the transmission of ultraviolet light to all parts of the treatment volume.

SUMMARY OF THE INVENTION

An ultraviolet exposure chamber contains a mechanism to generate a stable flow effect inside the chamber to increase the minimum dwell time of each volumetric unit of air entering the chamber. The chamber is designed to use momentum effects of the air to force the air to take a circuitous path through the chamber without the introduction of baffles or duct sections that would block ultraviolet light from centrally-mounted light sources.

In an exemplary embodiment, lamps are located across a central part of a plenum-type chamber and air is added via opposing nozzles located at opposite sides at a lower end of the chamber. The nozzles are offset so that a swirl flow pattern is generated. Thus, the flow is routed in a long swirling path through the chamber while being continuously exposed to the ultraviolet light. Since baffles are not required to route the flow along the long path, no light-blocking effect is suffered. This permits a smaller set of lamps to be used to expose the flow.

In another embodiment, the flow is introduced in such a manner that it is forced to swirl and take a helical path through the chamber. The light sources may be located in the center of the swirl effect minimizing their contact with suspended particles because of the resulting radial density gradient. The swirl has the secondary effect of causing particles to separate onto an exterior wall, which may be coated with a photocatalyst.

In yet another exemplary embodiment, flow through a chamber enters after being conditioned to minimize turbulent energy and its generation through shear. A low shear, possibly laminar, flow is introduced at one end of the chamber. Because of the low level (or absence) of turbulence, each unit volume of air dwells in the chamber for a minimum interval of time. Such a flow can be generated using settling screens and flow straighteners, for example. This type of geometry, however, may not be preferred due to cost considerations and manufacturing complexity.

Some of the embodiments, and others not described, may exploit the wall-flow (Coanda) effect to help insure minimal diffusion of mean flow energy into turbulent eddies. If the flow is very turbulent (large scale turbulence up to the length-scale of the flow chamber) then substantial portions of the flow can short-circuit the chamber. One way to create such a wall-flow is by injecting air into a chamber along a bounding wall section. The flow may follow the wall for some distance and may traverse the chamber according to various patterns depending on the design. The energy of a high velocity injected stream is not lost quickly to turbulence energy because the flow's dispersal and diminution of velocity are delayed.

While the invention will now be described in connection with certain preferred embodiments and examples and in reference to the appended figures, the described embodiments are not intended to limit the invention to these particular embodiments. On the contrary, it is intended to cover all alternatives, modifications, and equivalents as may be included within the scope of the invention as defined by the appended claims. Thus, the following description and examples of the preferred embodiments of the invention are only intended to illustrate the practice of the present invention. The particular embodiments are shown by way of example and for purposes of illustrative discussion of the preferred embodiments of the present invention.

The particular embodiments are presented in the cause of providing what is believed to be the most useful and readily understood description of the principles and conceptual aspects of the invention. In this regard, no attempt is made to show structural details of the invention in more detail than is necessary for a fundamental understanding of the invention. The description, taken with the drawings, makes it apparent to those skilled in the art how the several forms of the invention may be embodied in practice.

DETAILED DESCRIPTION OF THE ILLUSTRATED EMBODIMENTS

Figure 1:
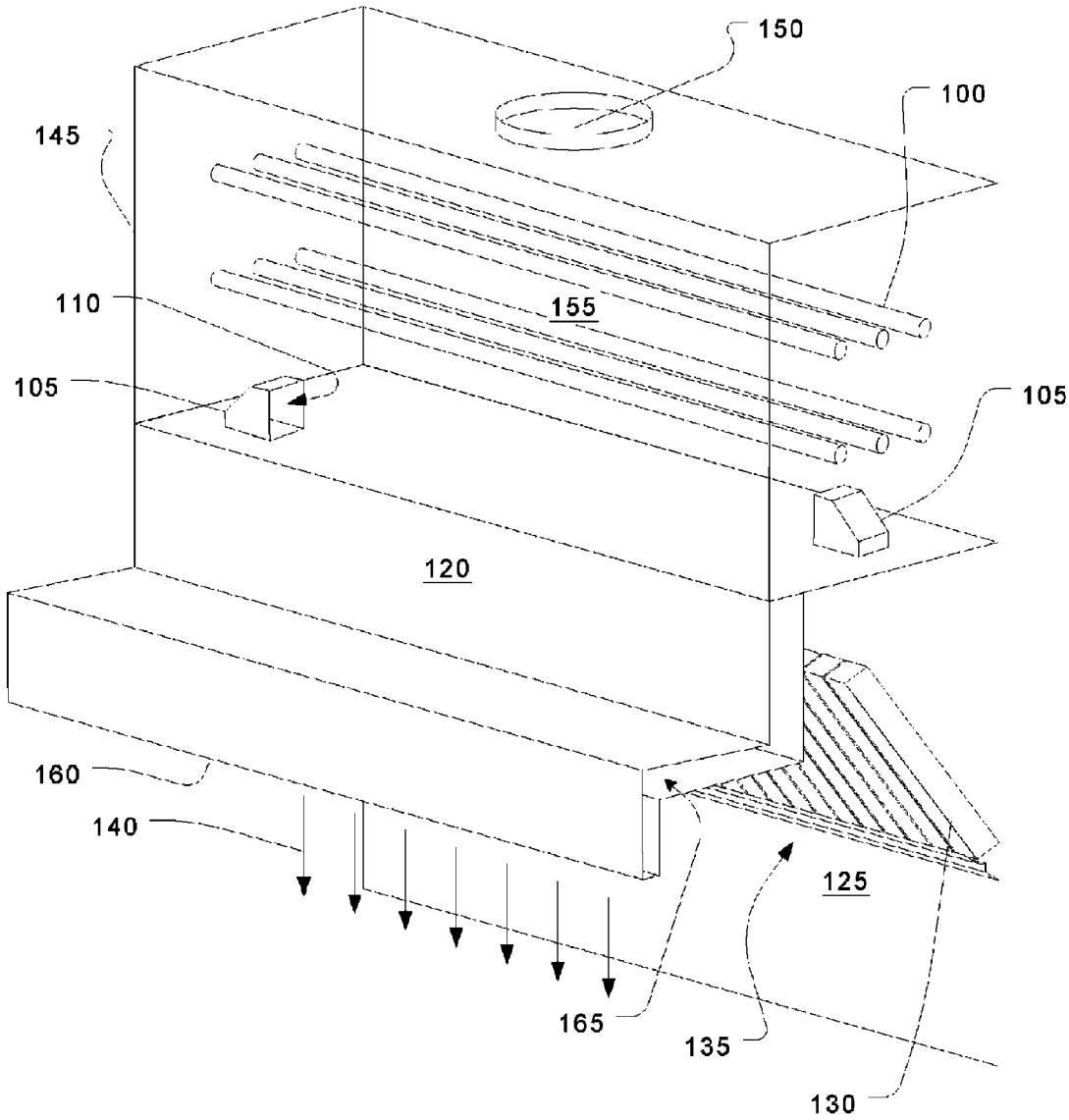
FIG. 1 is an illustration of an effluent gas treatment device attached to a back-shelf style of range hood according to an embodiment of the invention.

Referring to FIG. 1, exhaust fumes are drawn into an exhaust hood 160 and through a filter bank 135. Suction applied by an exhaust system (not shown) attached through a collar 150 draws the fumes through an ultraviolet treatment chamber 145. Ultraviolet lamps 100 are arranged to transmit light throughout the interior 155 of the ultraviolet treatment chamber 145. Exhaust fumes and air enter the ultraviolet treatment chamber 145 through opposed nozzles 105 with outlets 110.

The style of the exhaust hood 160 is a backshelf, but it could be any type of system that draws fumes containing hydrocarbons or organic particulates that can be treated with ultraviolet light. Most such hoods have a recess 125 that acts as a buffer for the exhaust stream and helps to match fluctuations in fumes with the uniform flow rate of the exhaust. As in some types of range hoods, an air curtain 140 may be generated by discharging clean air from a plenum 165 formed in a forward portion of the hood 160. This may increase the effective volume of the recess. The volume of the ultraviolet treatment chamber 145 is preferably as great or greater than that of the recess.

Figure 2:
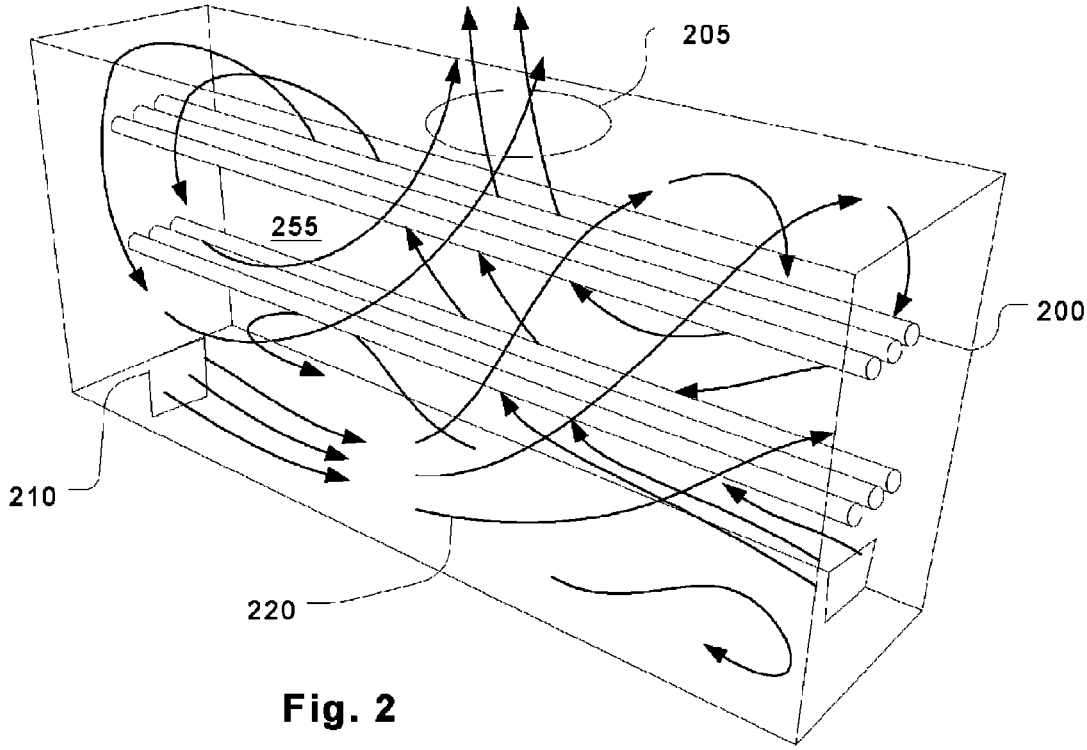
FIG. 2 is an illustration of the flow pattern generated by the effluent gas treatment device of FIG. 1.

Referring to FIG. 2, the flow through the nozzle 105 outlets 210 generates a swirling flow pattern that causes the majority of the air and fumes to take a circuitous route through the ultraviolet treatment chamber 145. The result is that the suspended particles in the effluent stream irradiated by the lamps 200 for a uniform time interval than if the flow contained short cuts and stagnant flow regions. One could describe the flow pattern as being similar to what would be achieved with baffles—effectively an elongation of the flow path—without the occultation of the radiation from the lamps 200. Thus, the energy of each lamp is used to greatest effect. If greater residence time is desired, the volume of the ultraviolet treatment chamber 145 may be increased.

The above embodiments prolong the residence time of the treated fumes, guarantee a large percentage of the fumes are irradiated, while simultaneously maximizing the effectiveness of ultraviolet light by avoiding the use of flow diverters or guides which would block light and require more light sources.

Figure 3:
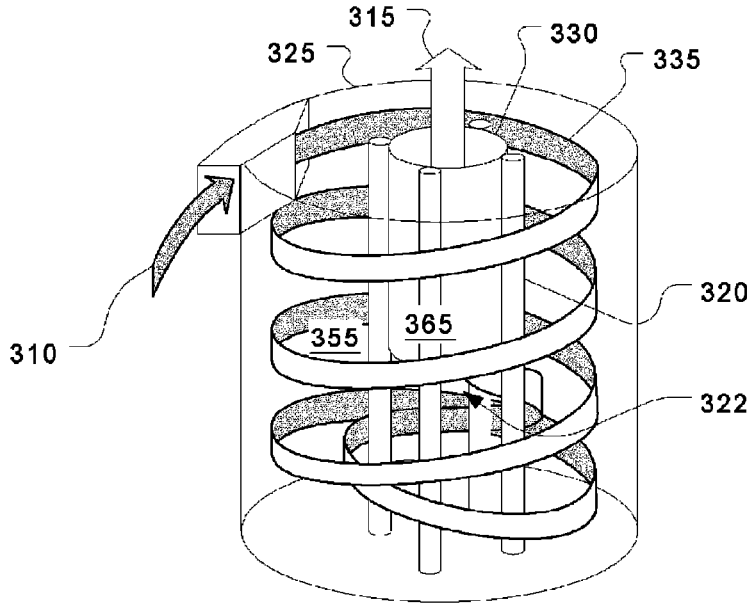
FIG. 3 is a partial ghost view of a first swirling flow-type effluent treatment chamber according to an embodiment of the invention.

Referring to FIG. 3, another configuration that provides an effectively-circuitous channel without the need for baffles or other flow diverters is a vortex chamber 325. An entering flow 310 enters an internal space 355 of cylindrical vortex chamber 325 having a longitudinal axis, which is the axis that runs along the longitudinal dimension (e.g., vertical length) of the vortex chamber, at a tangent causing a vortex flow 335. Gases flow out of the vortex chamber through an exit 322. The vortex flow 335 forms a helical flow pattern because of a mean flow in the vertical direction toward the exit 322. The inlet is positioned remotely from the exit 322 and spaced apart from the exit 322 along the longitudinal axis such that the entering flow 310 flowing into the vortex chamber 325 through the inlet traverses a substantial portion of a longitudinal dimension of the vortex chamber 325 to reach the exit 322. Flow from the exit 315 is directed by an exhaust duct 330 to an exhaust system (not shown). An array of ultraviolet lamps 365 is positioned within the vortex chamber 325 to irradiate particulates in the effluent defining the vortex flow 335. Because the effluent takes a circuitous route through the chamber, a substantially uniform residence time is achieved. Because the circuitous flow is established without the use of barriers, only a single ultraviolet source may be used with minimal waste of light due to absorption by surfaces other than those of the particulates.

Figure 4:
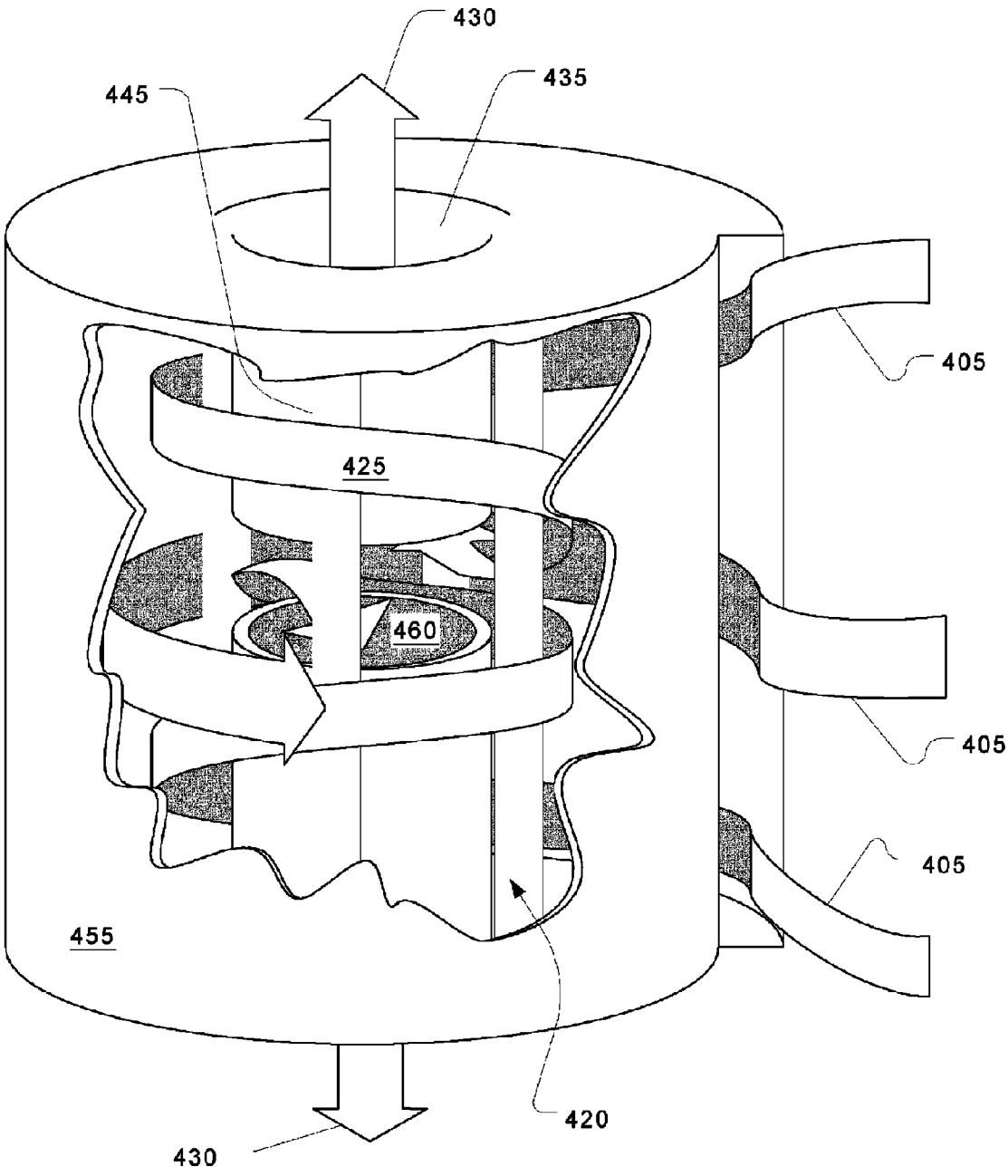
FIG. 4 is a partial cutaway view of second swirling flow-type effluent treatment chamber according to another embodiment of the invention.

Referring to FIG. 4, another flow configuration has a vortex chamber 455 in which an entering flow 405 is drawn in and through the vortex chamber 455 and withdrawn from it through a dual port exit 460. The exiting flow 430 is directed to an exhaust system. As in all the embodiments, the flows may be driven by positive or negative static pressure or thermal convection according to the various techniques known in the prior art. As in the embodiment of FIG. 3, the entering flow 405 is injected at a tangent of the vortex chamber 455 generating a vortical flow 425 which forms a helix due to the mean flow in the vertical direction. Ultraviolet lamps 420 irradiate the effluent defining the vortical flow 425.

Figure 5:
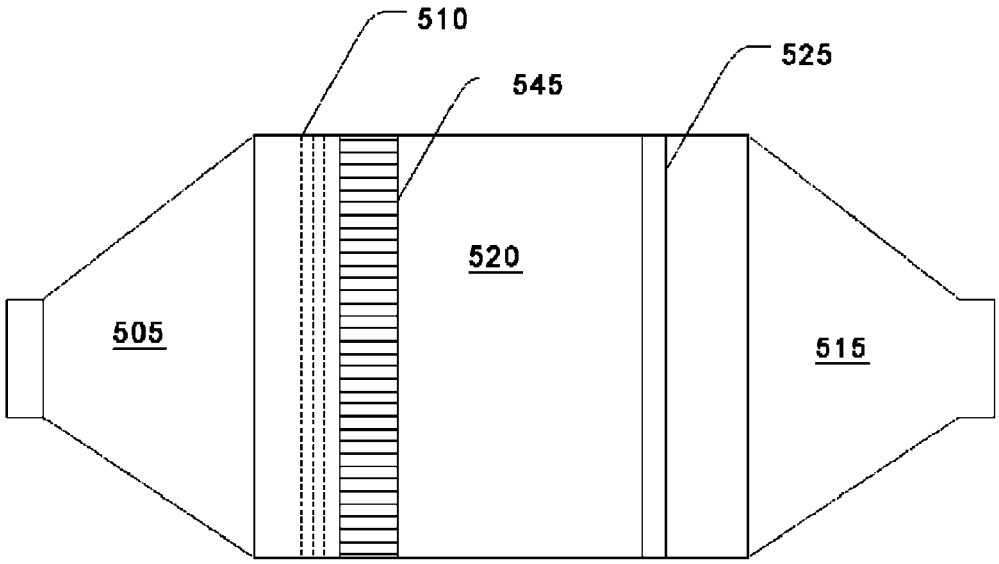
FIG. 5 is a partially-ghosted side view of a flow-settling chamber with ultraviolet light sources for treatment of effluent streams according to yet another embodiment of the invention.

Referring to FIG. 5, another mechanism for insuring long residence time while simultaneously insuring uniform residence time across a given flow volume is to inject a flow into a large chamber which slows the mean flow down while minimizing the large-scale turbulence that causes short-cuts. FIG. 5 shows an inlet transition, leading to a treatment chamber 520. Settling screens 510 and/or flow straighteners 545 may be used to filter out large-scale turbulent energy. The treatment chamber 520 has a plurality of parallel flow straighteners 545 configured to remove turbulence larger than a maximum dimension of the flow vessel (e.g., large-scale turbulence). One or more ultraviolet sources 525 are provided to irradiate the effluent stream as it flows through the treatment chamber 520. An outlet transition 515 directs the exiting flow to an exhaust system (not shown).

The embodiments of FIGS. 2-5 may be connected to an exhaust source of any kind. For example, as shown in FIG. 1, the exhaust source may be a kitchen range hood 160. Although in the embodiments discussed above the ultraviolet lamps were illustrated as tubular structures suggestive of fluorescent-type lamps, it should be understood that the invention may be used with any type of ultraviolet source such as arc lamps, gas-discharge of any type, etc. Also, although a filter bank 135 appears in the embodiment of FIG. 1, it should be understood that such a grease filter may or may not appear in such a system. Also, the ultraviolet treatment chamber 145 may or may not be located adjacent to the exhaust hood 160 as illustrated.

Figure 6:
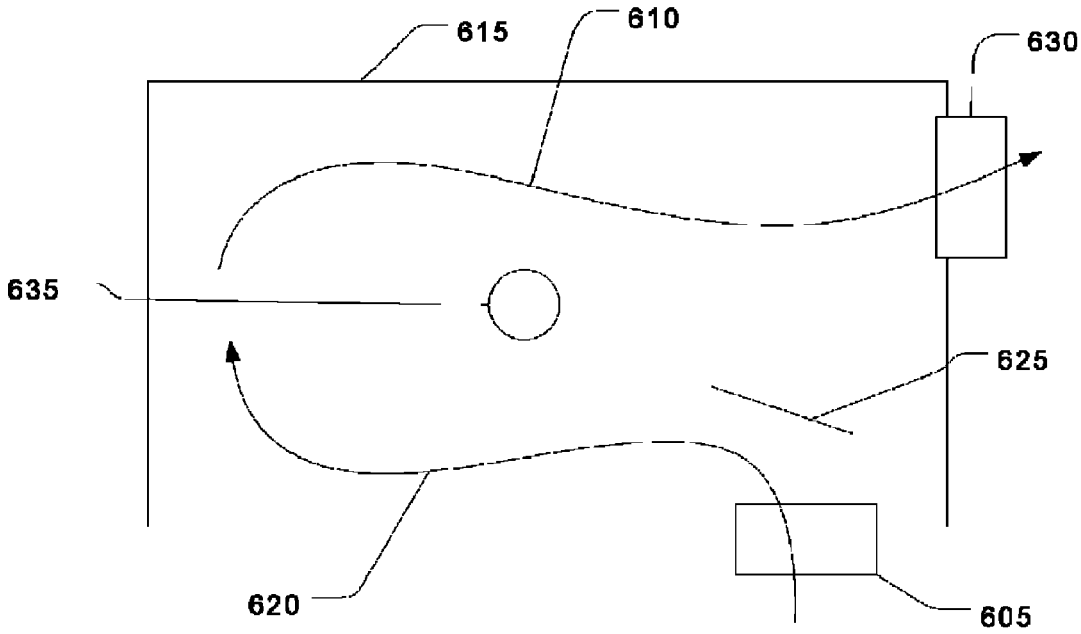
FIG. 6 is a partially ghosted side view of a treatment chamber relying on a Coanda effect to generate a circuitous stream.

Referring now to FIG. 6, to show that flow diverters may be used and still provide the benefits described above, an embodiment creates a circuitous flow by relying on the wall-flow or Coanda effect. Effluent flow enters a treatment chamber 615 through an inlet 605 and is diverted to flow along a wall by a flow diverter 625. A wall-flow 610, 620 adheres to an internal wall of the chamber 615 and flows toward an outlet 630. An ultraviolet source 635 is placed in the chamber 615 to irradiate the effluent stream. Note that additional flow diverters may be used as guides in said treatment chamber 615 to insure a certain flow pattern but without blocking a large percentage of the light from the ultraviolet source 635. The at least one flow diverter 625 is positioned between the inlet 605 and the ultraviolet light source 635 and is angled to divert toward a wall of the treatment chamber 615. The inlet 605 and the outlet 630 are positioned at separate positions of the treatment chamber 615, the treatment chamber wall being continuous and uninterrupted between the inlet 605 and the outlet 630 such that a Coanda flow 610, 620 from the inlet to the outlet can be established without being deflected away from the wall before reaching the outlet. The ultraviolet light source 635 is located remotely from the wall so that the Coanda flow 610, 620 can remain remote from the ultraviolet light source 635 between en entire span of the wall separating the inlet and the outlet.

Figure 7:
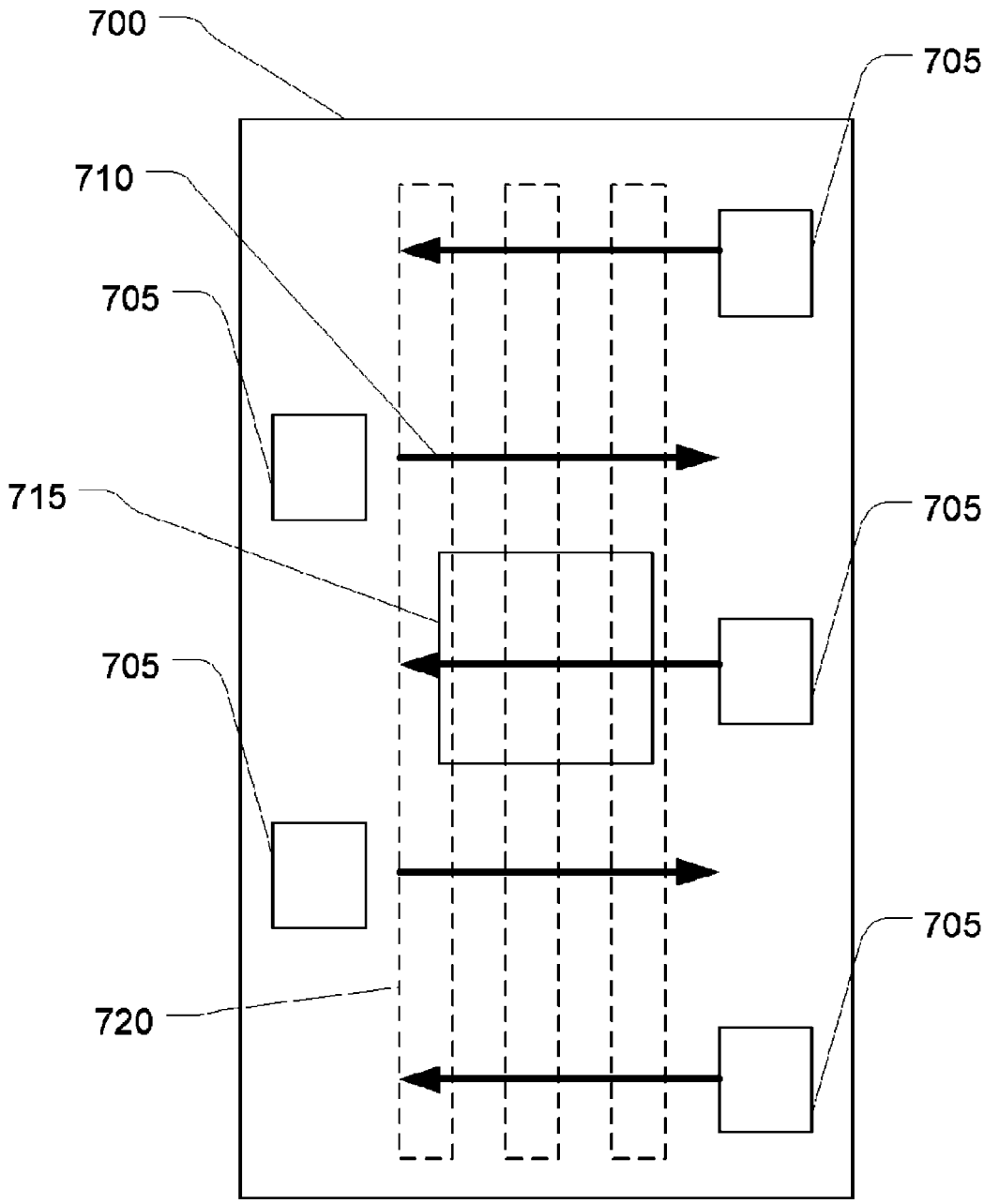
FIG. 7 shows a variation of the embodiment of FIG. 2 in which fumes enter a plenum having UV lamps through multiple inlets arranged in opposing arrays.

FIG. 7 shows a variation on the embodiment of FIG. 2 in which fumes enter a plenum 700 with UV lamps 720 through multiple inlets 705 arranged in opposing arrays such that each adjacent inlet 705 directs flow in a manner that generates high strain. In the example shown, each pair of adjacent inlets 705 are aimed in opposite directions. An outlet 715 conveys air to an exhaust.

It will be evident to those skilled in the art that the invention is not limited to the details of the foregoing illustrative embodiments, and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An ultraviolet treatment device, comprising:

a kitchen exhaust hood with a plenum attached thereto and in flow communication with an exhaust stream from said hood;

said exhaust hood having a recess;

said plenum containing at least one ultraviolet light source;

said plenum having a volume at least as great as an interior volume of said recess;

said plenum being configured to generate a flow therethrough that takes at least one turn, said flow being exposed to said light during a majority fraction of a residence time in said plenum;

wherein said plenum has two inlets connecting said recess to an interior thereof, said inlets being arranged to generate a circulating flow in said plenum;

wherein said inlets are opposed nozzles.

2. The device of claim 1, wherein the plenum has a rectangular interior cross section such that the flow vessel wall includes planar faces, the inlet and outlet being in first and second planar faces, respectively.

3. The device of claim 2, wherein a diverter is angled with respect to the inlet to direct a flow along the first planar face.

4. The device of claim 3, wherein the ultraviolet light source is confined to a central region of the cross section such that flow following a Coanda flow can flow substantially around the ultraviolet light source, whereby a majority of any dirt in the flow is guided around the ultraviolet light source thereby inhibiting fouling.

* * * * *

UNITED STATES PATENT AND TRADEMARK OFFICE

CERTIFICATE OF CORRECTION

PATENT NO. : 8,002,881 B2
APPLICATION NO. : 11/308334
DATED : August 23, 2011
INVENTOR(S) : Rick Bagwell et al.

It is certified that error appears in the above-identified patent and that said Letters Patent is hereby corrected as shown below:

On the title page:

Item (75) Inventors: Please correct the spelling of the second-listed inventor from "Darren Beardslee" to --Darrin Beardslee--.

Signed and Sealed this
Twentieth Day of March, 2012

David J. Kappos

David J. Kappos
*Director of the United States Patent and Trademark Office*